US005418339A

United States Patent [19]

Bowen et al.

[11] Patent Number: 5,418,339

[45] Date of Patent: May 23, 1995

[54] PNEUMATIC TOOL HAVING NOISE REDUCING MUFFLING STRUCTURE

[75] Inventors: Gloria D. Bowen, Eagan; Zubin P. Daruwala, Minneapolis; David W. Hegdahl, Lino Lakes; Thomas J. Scanlan, Woodbury; Jeffrey W. McCutcheon, Eagan, all of Minn.

[73] Assignee: Minnesota Mining and Manufacturing Company, St. Paul, Minn.

[21] Appl. No.: 276,771

[22] Filed: Jul. 18, 1994

Related U.S. Application Data

[63] Continuation of Ser. No. 148,586, Nov. 4, 1993, abandoned.

[51] Int. Cl.[6] ..... F01N 3/00

[52] U.S. Cl. ..... 181/230

[58] Field of Search ..... 181/229, 230, 231, 258, 181/286, 294

[56] References Cited

U.S. PATENT DOCUMENTS

| | | | |
|---|---|---|---|
| 1,115,704 | 11/1914 | Manes . | |
| 2,931,089 | 4/1960 | Evans . | |
| 3,429,728 | 2/1969 | Goldstone et al. . | |
| 3,595,738 | 7/1971 | Clarke et al. . | |
| 3,619,874 | 11/1971 | Li et al. . | |
| 3,868,749 | 3/1975 | Cate . | |
| 3,880,245 | 4/1975 | Anderson . | |
| 3,896,897 | 7/1975 | Hillbush . | |
| 3,968,843 | 7/1976 | Shotwell . | |
| 4,018,291 | 4/1977 | Anderson . | |
| 4,033,428 | 7/1977 | Wennerstrom . | |
| 4,042,062 | 8/1977 | Tooley . | |
| 4,205,732 | 6/1980 | Auerbach et al. | 181/230 |
| 4,258,798 | 3/1981 | Campbell et al. | 181/230 X |
| 4,351,225 | 9/1982 | Brandenberg et al. . | |
| 4,410,481 | 10/1983 | Mayerhoffer . | |
| 4,558,763 | 12/1985 | Mentebart . | |
| 4,662,474 | 5/1987 | Cheng . | |
| 5,189,267 | 2/1993 | Ligman | 181/230 |
| 5,206,081 | 4/1993 | Fredriksson . | |
| 5,213,167 | 5/1993 | Best et al. . | |

FOREIGN PATENT DOCUMENTS

WO92/20751 11/1992 WIPO .

*Primary Examiner*—M. L. Gellner
*Assistant Examiner*—Khanh Dang
*Attorney, Agent, or Firm*—Gary L. Griswold; Walter N. Kirn; Janice L. Dowdall

[57] ABSTRACT

The present invention relates to a pneumatic tool having superior sound muffling performance. The pneumatic tool has an exhaust port, wherein a sound muffling structure comprising a nonwoven web of fibers coated with a binder resin, is fitted in said exhaust port to seal said exhaust port, wherein said fibers have diameters of about 30 to about 100 microns and wherein the web has a compression resistance energy of about 0.09 to about 0.14 Joules.

8 Claims, 1 Drawing Sheet

PNEUMATIC TOOL HAVING NOISE REDUCING MUFFLING STRUCTURE

This is a continuation of application Ser. No. 08,148,586, filed Nov. 04, 1993, now abandoned.

FIELD OF THE INVENTION

The invention relates to a pneumatic tool having an improved sound muffling structure contained therein.

Background of the Invention

Pneumatic tools, or air driven tools are known and commonly employed in many industrial and residential uses. Various types of pneumatic tools include air hammers, ratchets, drills, wrenches, and the like. The tools typically include a chamber in the housing of the tool that is adapted to receive compressed air from an air line. The air flows through the chamber to an air motor which drives the tool, and excess air flows back through an exhaust port in the tool. As the air is vented through the exhaust port, a considerable amount of noise is generated which could cause auditory damage to anyone within the vicinity of the operating tool. There is evidence that indicates that hearing loss will occur at exposure to an eight hour time weighted average noise level above 90 decibels (dBA).

There is a desire, and a regulated need, in industry to lower the noise level of pneumatic tools down to 85 dBA or lower. Noise or sound is typically measured on a decibel system which is logarithmic. A 3 dBA difference in noise level represents a difference in the sound energy output of the tool by a factor of about two. A 10 dBA increase shows an increase of ten times the sound energy. As a protective mechanism, the human ear perceives a 10 dBA increase in sound as being twice as loud. Noise levels about 95 dBA can be painful. Noise levels in a "quiet" room, i.e., a room with no machines running, are typically in the range of 50–65 decibels.

Although protective ear plugs can be available to workers, they are often not used for any number of reasons—i.e., they are inconvenient to use, they get lost, workers don't want the bother of using them, etc. They also represent an economic liability which could be avoided by preventive measures such as quieting the tool.

Numerous attempts have been made to suppress the noise generated by air tools; these include modifying the housing and exhaust ports of the tools to diffuse the sound energy before the air is exhausted, and putting various types of mufflers in or around the exhaust port.

For example, U.S. Pat. No. 3,896,897 describes a muffler assembly with apertures that are wrapped around the exhaust port of the tool. The muffler assembly is described as having three layers—an impregnated fabric laminated to a sheet of lead or nonresonating metal, and a porous sheet material.

U.S. Pat. No. 5,189,267 describes an air tool muffler system having a foraminous material located between the tool and heat shrunk tubing that is disposed about the tool. An example of a foraminous material in the patent is a Heavy Duty Stripping Pad made by Minnesota Mining & Manufacturing Co.

Commercially available tools also have various types of mufflers in the tool. A commercially available tool from ARO Corporation has a nonwoven material placed in the exhaust port. The material is made from fibers having an average diameter of about 57 micrometers and is needletacked and lightly resin bonded.

Another commercially available pneumatic tool from ARO has a nonwoven material having fiber diameters of about 28 micrometers, wherein the nonwoven material has a moderate amount of binding resin.

Snap-On Tools, Inc. sells pneumatic tools having a muffler in the exhaust housing. The muffler is a certain nonwoven material having approximately a 50/50 blend of fibers that are 45 micrometers and 29 micrometers in diameter. The web is also lightly bonded with resin.

The mufflers will muffle the sound, but there is often an increase in back pressure in the exhaust port causing a decrease in the operating efficiency of the tool. Increases in back pressure result in additional resistance to the working air which in turn reduces the available energy to drive the tool and proportionately slows the speed at which the tool can be run. The efficiency of a tool is typically measured in the operating speed of the motor in revolutions per minute (RPM) at a certain gauge pressure of the air line.

Although current approaches are workable, there exists a continuing need for a noise muffling system that can reduce sound levels and minimally affect the performance of the pneumatic tool over long periods of time. In particular, it would be desirable to have a sound muffling system that can be easily fitted into an existing air tool, could lower the noise level of an air tool to below 90 dBA without decreasing the tool rpm performance by more than about 15%, and maintains the sound muffling performance for several days or longer of continuous use. Currently used materials have been found to provide only a temporary balance between operating speed and noise control.

Summary of the Invention

We have discovered a pneumatic tool having a superior sound muffling structure that is also longlasting. The muffling structure is resistant to compression from long term exposure to moisture and oil, and exhaust air pressure.

We have discovered a pneumatic tool having an exhaust port, wherein a sound muffling structure comprising a nonwoven web of fibers and binding resin is fitted into the exhaust port to seal the exhaust port, wherein the fibers have diameters of about 30 to about 100 microns and wherein the web has a compression resistance energy of about 0.09 to about 0.30 Joules.

In the practice of the present invention, the sound muffling structure is useful in a wide variety of pneumatic tools such as hammers, ratchets, grinders, sanders, impact wrenches, drills, and the like.

Currently used materials tend to become compressed after exposure to the moisture and oil in the air lines at the operating air pressure. In use, air tools are usually supplied with compressed air from an air line. The compressed air typically contains some moisture from the air as well as a small amount of oil that is added to the air line for lubrication of the air motor. When the air is exhausted from the motor, this combination tends to compress the structure in the exhaust port. Excessive compression of the structure can increase the flow resistance through the exhaust port and thereby decrease the performance of the tool.

DETAILED DESCRIPTION OF THE INVENTION

Figure 1:
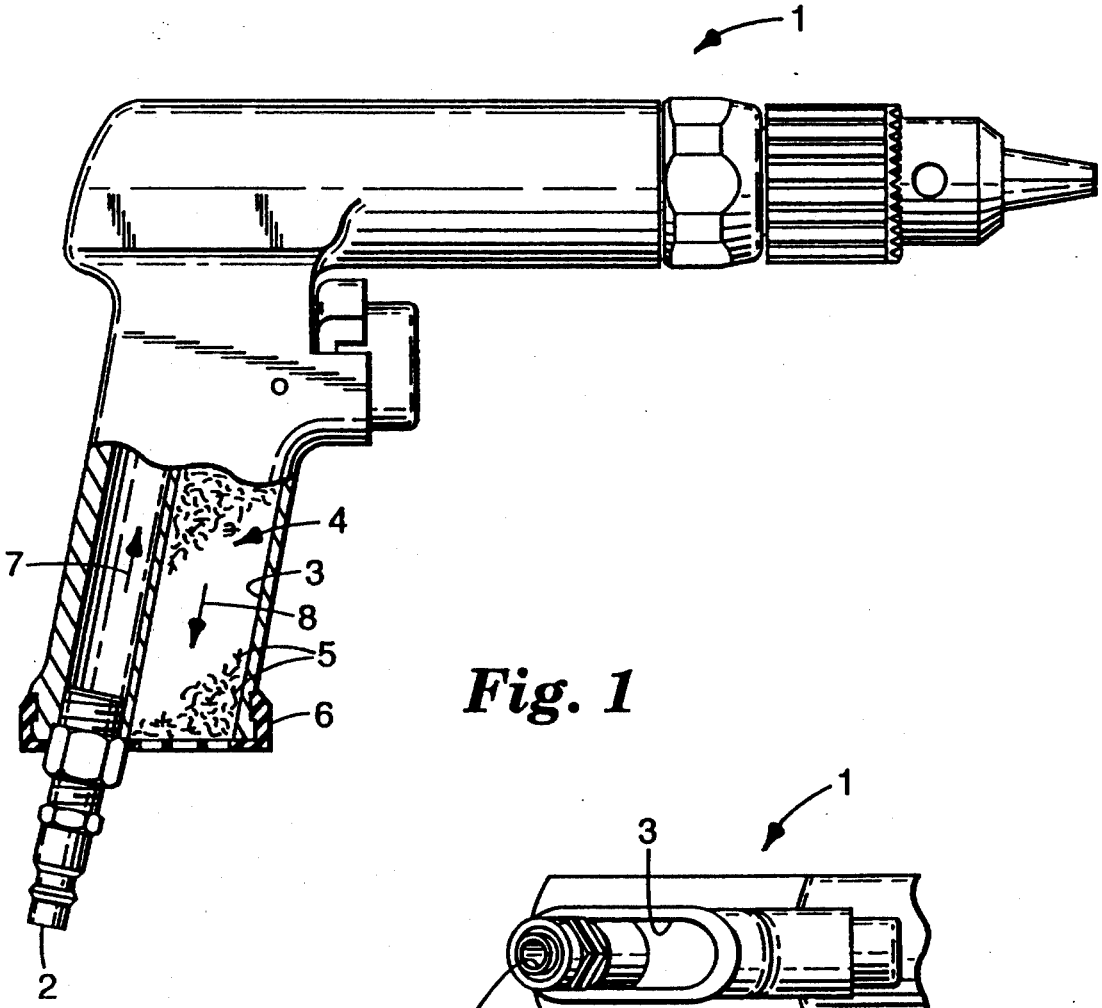
FIG. 1 is a side view of a pneumatic drill with the handle broken away to show the sound muffling structure in the exhaust port.

The sound muffling structure is a semi-rigid (defined in terms of compression resistance energy, discussed infra) nonwoven web constructed of fibers and binding resin.

The fibers useful according to the invention can be natural and/or synthetic polymeric fibers. Examples of useful natural polymeric fibers include but are not limited to those selected from the group consisting of wool, silk, cotton, and cellulose. Examples of useful synthetic polymeric fibers include but are not limited to those selected from the group consisting of polyester resins, such as polyethylene(terephthalate) and polybutylene (terephthalate), polyamide resins such as nylon, and polyolefin resins such as polypropylene and polyethylene, and blends thereof. The synthetic fibers are preferred for their better oil, water, and oxidative resistance which contribute significantly to long term muffler performance. The fibers should have a diameter in the range of about 30 micrometers to about 150 micrometers, and preferably, in the range of about 35 to 100 micrometers. The fibers can have diameters less than 30 micrometers if they are capable of being twisted or otherwise formed together to form a larger diameter fiber. Fibers having diameters less than about 30 micrometers tend to be too soft and can be compressed too much during extended use. This compression can lead to an undesirable increase in back pressure. Webs formed from fibers that are too large in diameter may not attenuate the noise effectively. Although fiber length is not particularly critical, suitable fibers typically range in length from about 30 millimeters to about 100 millimeters, and are preferably about 35 to 50 millimeters in length for ease in web forming. Blends of fibers of varying lengths and diameters can be used for the nonwoven web.

Useful fibers also include but are not limited to melt bondable fibers which can be of the sheath-core type wherein the core of the fiber is a polymer having a relatively high melting temperature compared to the surrounding sheath polymer, such that in forming the web, the melting of the sheath causes it to flow to and bond to surrounding web fibers. Typically, the difference in melting point between the sheath and core is about 10° C. to about 40° C., more typically about 20° to about 40° C. difference. Examples of useful melt bondable fibers include but are not limited to those selected from the group consisting of polyester/polyester copolymer blends, polyester/polypropylene fibers, and the like. Sheath core fibers are commercially available from sources such as Hoescht-Celanese, DuPont Company, and Eastman Kodak.

It is also preferred that the fibers used for the nonwoven web are texturized to provide a three-dimensional characteristic to the web. This can be accomplished via methods known in the art as disclosed in U.S. Pat. Nos. 2,931,089, 3,595,738, 3,619,874, and 3,868,749, all of which are herein incorporated by reference. Crimped fibers typically have about 1 to about 20 crimps/cm, preferably about 2 to about 10 crimps/cm. Crimped fibers are commercially available from a number of sources including E.I. dupont deNemours, BASF, Hoescht-Celanese and Eastman Kodak.

The nonwoven web useful according to the invention can be formed by conventional techniques to make air laid nonwoven webs or mechanically laid nonwoven webs. Equipment used to make mechanically laid fibers include commercially available equipment from Hergeth KG, Hunter, and others. Equipment to form air laid nonwoven webs is commercially available from Proctor & Schwarts, Dr. O. Angleitner (DOA), and Rando Machine Corporation.

The nonwoven web useful according to the invention is coated or saturated with a binder resin that when cured will impart significant additional resistance to oils and moisture to the web. The binder resins also serve to stiffen the nonwoven web so that it resists compression in use. These resins are generally thermoset polymeric compositions, and are selected to be resistant to oils and water. Suitable binder resins include but are not limited to those selected from the group consisting of phenolaldehyde resins, butylated urea aldehyde resins, epoxide resins, polyester resins (such as the condensation products of maleic and phthalic anhydrides, and propylene glycol), acrylic resins, styrene-butadiene resins, plasticized vinyl, polyurethanes, and mixtures thereof. The binder resins can further include fillers such as talc, silica, calcium carbonate, and the like to enhance the stiffness of the web. The binder resins can be provided in a water emulsion or latex, or in an organic solvent.

Sufficient binder resin is added to hold the fibers in place without becoming overly stiff. The muffling structure must have enough conformability so that when it is inserted into the tool, the structure will form a 'seal' in the exhaust port so that substantially all of the exhaust air goes through the muffler structure instead of bypassing the structure through large gaps between the structure and the exhaust port chamber. The seal is such that typically greater than 90% of the air goes through the muffling structure, preferably 95% or greater, more preferably 99% or greater, and most preferably 100%.

The amount of binder resin useful in the practice of the invention is typically about 100 to 400 parts by weight of dry resin per 100 parts by weight of nonwoven web. Preferably, the binder resin is used in an amount of 130 to 230 parts by weight per 100 parts of nonwoven web for optimal compression and acoustic performance.

The nonwoven web can optionally include a saturant coating of a viscoelastic composition to further decrease the sound generated by the tool. Useful viscoelastic materials include oil and water resistant viscoelastic damping polymers such as polyacrylates, styrene butadiene rubbers, silicone rubbers, urethane rubbers, nitrile rubbers, butyl rubbers, acrylic rubbers, and natural rubbers and acrylic based viscoelastic materials such as Scotchdamp TM ISD 110, Scotchdamp TM ISD 112 and Scotchdamp TM ISD 113, (3M Company, St. Paul, Minn.). The polymers may be dispersed into a suitable solvent and coated onto the nonwoven structure. The polymer solution typically has 1% to 7% polymer solids by weight and preferably is a 2% to 5% solids solution. The polymer should be stable at the use temperature of the pneumatic tool which typically ranges from about −40° C. to about 50° C., more typically about 5° C. to about 40° C. The polymer has a loss factor greater than about 0.2, preferably greater than 0.5 most preferably greater than 0.8 at the use temperature (21° C. for example).

The muffling structure useful according to the invention should be stiff enough to resist compression in the exhaust port. The energy required to compress the structure is a measure of the resilience of the nonwoven structure and of its ability to perform as a muffler in a pneumatic tool. It has been discovered that a nonwoven structure having the requisite fiber diameter and a compression resistance energy of about 0.09 to about 0.30 Joules, and preferably about 0.10 to about 0.14 Joules, will provide a superior balance of muffling ability, low back pressure, and resistance to compression in a pneumatic tool.

Typically each dimension of the muffling structure (height, width, length) is about 1.05 to about 1.5 times the dimension of the exhaust port cavity to ensure an adequate fit and seal of the exhaust port cavity.

Referring to the drawings, FIG. 1 illustrates a pneumatic drill 1 having an air inlet 2 through which air enters the drill 1. The incoming air flow is indicated by reference numeral 7. After powering the tool the outgoing air flow passes through an exhaust cavity defined by exhaust cavity wall 3. The path of the outgoing air is defined by reference numeral 8. The muffling structure 4 is contained within the walls 3 of the exhaust cavity. A perforated cap 6 serves to secure the muffling structure 4 into the exhaust cavity.

Figure 2:
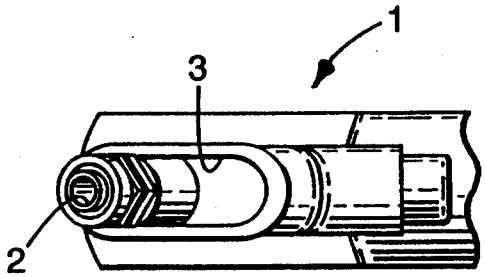
FIG. 2 is a partial bottom view of a pneumatic drill without the muffling structure and perforated exhaust cap.

FIG. 2 illustrates a partial bottom view of a pneumatic air drill 1 having the muffling structure 4 removed and in addition having the perforated cap 6 removed. The air inlet being defined by 2 and the exhaust cavity wall by 3.

Figure 3:
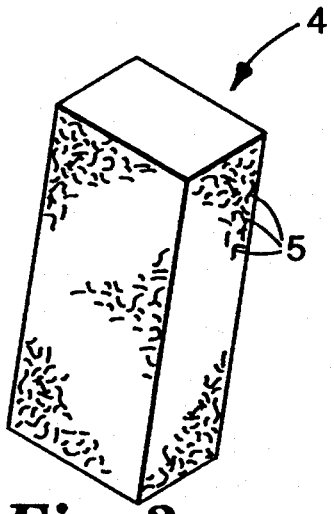
FIG. 3 is a perspective view of a sound muffling structure before it is inserted into the exhaust cavity.

FIG. 3 illustrates a rectangular section of muffler material 4 which can be inserted into the pneumatic drill 1. The fibers are indicated by reference numeral 5.

Figure 4:
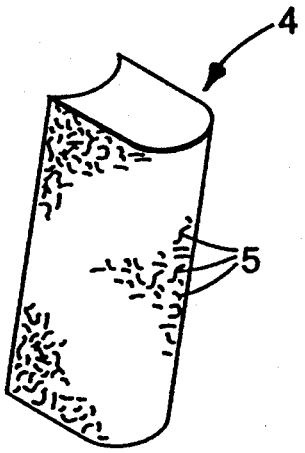
FIG. 4 is a perspective view of the sound muffling structure as it conforms to the exhaust cavity of the pneumatic drill.

FIG. 4 is a perspective view of the muffler 4 as it is conformed to the exhaust cavity. It is apparent that the muffling structure has taken on the same shape as defined by the exhaust cavity wall 3 in FIG. 2. It is not necessary that the muffling structure have a rectangular shape although it is a conveniently useful shape for a pneumatic drill having such an exhaust port. The muffling structure could take on a number of shapes including circular, square, cylindrical, or whatever geometry necessary to adequately fill and seal the exhaust cavity.

TEST PROCEDURES

Compression Resistance Energy

This test is a measure of the energy required to compress a structure to a resistance of 0.565 Joules. The test is conducted on a compression tester (Sintech TM 2 manufactured by Sintech, Inc.) which has a flat bottom plate measuring 152 mm by 254 mm attached to the bottom jaw of the tester. The upper jaw is fitted with a flat ended metal cylinder having a diameter of 9.52 mm and an area of 71.0 square mm. A sample of the structure, conditioned at room temperature 21° C. and 50% relative humidity, is placed on the bottom plate such that it is centered under the metal cylinder attached to the upper jaw. The sample is then compressed at a compression rate of 5.08 millimeters per minute up to a load of 2.27 kg and a curve of load versus compression is plotted. The area under the curve is then integrated to determine the compression resistance energy.

Tool Performance and Sound Energy

The measured background noise should be between about 50–55 decibels (dBA) to avoid significant noise contribution from other sources. The performance of a pneumatic drill is determined by operating the drill without a muffler at an air line pressure of $6.895\times10^5$ Pascals and measuring the revolutions per minute (RPM) of the motor. The muffler structure, cut to dimensions of 25.4 mm by 60.2 mm by about 19 mm, is then inserted into the exhaust port of the same pneumatic drill and operated at an air line pressure of $6.895\times10^5$ Pascals. The RPM with the muffler should be no less than 85% of the RPM without the muffler. The RPM is measured with a "Computak TM" tachometer, model 8203-00 from Cole-Parmer after a steady reading is reached.

The sound energy is measured at a distance of 1 meter away from the operating drill with a hand held decibel meter (CEL-231 available from Lucas Industrial Instruments 760 Ritchie Highway, Suite 106, Severna Park, Md. 21146). The decibel meter reading is taken after the large fluctuations in the noise from the drill has stopped and is the average reading of a 30-second interval.

EXAMPLES

The following Examples are representative of the present invention and are not considered to be limiting. All parts, percentages, ratios, etc., in the Examples and the rest of the specification are by weight unless indicated otherwise.

Example 1

A random air-laid nonwoven web was formed from a blend of 40 weight percent 41 micron diameter nylon fibers, 20 weight percent 61 micron diameter nylon fibers, and 40 weight percent 41 micron sheath core polyester/copolyester fibers.

The sheath core polyester/copolyester copolymer fibers are made as follows.

Chips made of poly(ethylene terephthalate) having an intrinsic viscosity of 0.5 to 0.8 were dried to a moisture content of less than 0.005% by weight and transported to the feed hopper of the extruder which fed the core melt stream. A mixture consisting of 75% weight of semicrystalline chips of a copolyester having a melting point of 103° C. and intrinsic viscosity of 0.72 ("Eastobond" FA300, Eastman Chemical Company) and 25% by weight of amorphous chips of a copolyester having an intrinsic viscosity of 0.72 ("Kodar" 6763, Eastman Chemical Co.) was dry-blended, dried to a moisture content of less than 0.01% by weight, and transported to the feed hopper of the extruder feeding the sheath melt stream. The core stream was extruded at a temperature of about 320° C. The sheath stream was extruded at a temperature of about 220° C. The molten composite was forced through a 0.5 mm orifice, and pumping rates were set to produce filaments of 50:50 (wt./wt.) sheath to core ratio. The fibers were then drawn in three steps with draw roll speeds set to produce fibers of 41 micron diameter filament with an overall draw ratio of about 5:1 to produce melt-bondable fibers, which were then crimped (9 crimps per 25 mm) and cut into staple fibers (40 mm long).

The fibers from which the web was formed had an average staple length of about 40 millimeters and about 4.7 crimps per centimeter. The fibers were formed on a DOA web former and the web weight was about 478 grams per square meter.

The nonwoven web was then passed through an oven at about 175° C. for three minutes at which time the polyester/polyester copolymer fibers were heated sufficiently to bond the fibers together and stabilize the web.

A saturant was prepared by mixing 10.2 parts (by weight) water, 14.4 parts of an 85/15 blend of propylene glycol monomethyl ether/water, 46.4 parts of a 70% solids base catalyzed phenol formaldehyde resin (available from Reichold Chemical as BB062), 9.7 parts chrome oxide, 4.6 parts calcium carbonate, 13 parts pumice, 0.4 parts dioctylsodium sulfosuccinate surfactant and 1.17 parts of a 3% dispersion of hydroxypropyl cellulose in tap water.

The saturant was coated onto the nonwoven web using squeeze rollers to distribute the saturant throughout the nonwoven web. The web was dried and cured in an oven at 175° C. for about six minutes. The dry web had a thickness of about 25 mm and a basis weight of about 1195 grams per square meter.

The finished web was then tested according to the aforementioned test procedures for Compression Resistance Energy, Tool Performance and Sound Pressure Level. Test results are shown in Table 1.

Comparative Examples C1–C4

C1—Nonwoven from pneumatic tool made by Snap-on Tools having approximately a 50/50 blend of fibers that are 45 micrometers and 29 micrometers in diameter. The web is also lightly bonded with resin.

C2—Heavy Duty Stripping Pad available from Minnesota Mining & Manufacturing Co. having a 150 micron diameter.

C3—Nonwoven from pneumatic tool made by ARO, Inc. having an average fiber diameter of about 28 micrometers. The nonwoven material has a moderate amount of binding resin.

C4—Needle tacked nonwoven from pneumatic tool made by ARO, Inc. having an average fiber diameter of about 57 micrometers. The material is lightly resin bonded.

The comparative examples were evaluated for Compression Resistance Energy, Tool Performance and Sound Pressure Level as in Example 1.

The results are reported in Table 1.

TABLE 1

| Example | Compression Resistance Energy - Joules | Sound Pressure Level dBA | Performance RPM |
|---|---|---|---|
| 1 | 0.119 | 83.5 | 520 |
| C1 | 0.010 | 95 | 550 |
| C2 | 0.093 | 93.5 | 550 |
| C3 | 0.016 | — | — |
| C4 | 0.023 | — | — |

*Run at 6.895 × $10^5$ Pascals line pressure

The data in Table 1 show that muffler structures useful according to Applicants' invention of the requisite compression resistance energy and fiber diameters exhibit superior performance as sound mufflers in an air tool.

Example 2

A nonwoven web was prepared as in Example 1 using a fiber blend of 75 weight percent 40 mm long 51 micron diameter crimped polyester staple fibers having about 8 crimps per 25 mm, and 25 weight percent 41 micron melt bondable polyester fibers described in Example 1. The heat stabilized web had a nonwoven web weight of 470 grams per square meter.

A vinyl plasticized dispersion was prepared by slowly adding 570 parts of a granular polyvinylchloride-vinyl acetate copolymer dispersion resin (commercially available from Occidental Corp. under the trade designation Oxy 565) to 430 parts diisononyl phthalate in a high shear mixer until a uniform dispersion was obtained.

A saturant was prepared by mixing 2000 parts hexamethylmethoxymelamine resin (Cymel TM 303 available from American Cyanamid), 160 parts of a 50% solids solution of para-toluene sulfonic acid in water, 120 parts of K15 hollow glass microspheres having a bulk density of 0.15 gm/$cm^3$ and an average particle size of 45 microns (available from Minnesota Mining & Manufacturing Co. under the trade name Scotchlite TM Brand glass bubbles), and 2000 parts of the aforementioned vinyl plasticizer dispersion.

The nonwoven web was squeeze roll coated and then heated in a 160° C. oven for 10 minutes to cure the binder resin. The web was then tested as in Example 1 and test results are shown in Table 2.

TABLE 2*

| Example | Compression Resistance Energy-Joules | Sound Pressure Level dBA | Performance RPM |
|---|---|---|---|
| 2 | 0.116 | 83 | 468 |
| C1 | 0.107 | 96 | 465 |
| C5 (No muffler) | — | 104 | 482 |

*measurements made at a lower air line pressure, less than 6.895 × $10^5$ Pascals. All tests run at the same line pressure.

Example 3

A 25% solids solution of an acrylate viscoelastic polymer (SJ 2125 available from Minnesota Mining & Manufacturing Co.) was diluted with ethyl acetate to form a 3% solids solution by weight. The muffler structure of Example 1 was placed in a container filled about half full with the 3% solution and capped. The container was then placed on a roller mill for about 6 hours. The muffler structure was then removed and placed on a paper towel for 10 minutes to drain the excess solution. The structure was then placed in a 40° C. oven for 30 minutes to dry off the residual solvent. Test results are shown in Table 3.

TABLE 3

| Example | Sound Pressure Level dBA | Performance RPM |
|---|---|---|
| 1 | 84 | 425 |
| 3 | 81 | 429 |
| C5 (No muffler) | 102 | 445 |

* All measurements done at same line pressure.

Various modifications of this invention will become apparent to those skilled in the art without departing from the spirit and scope of this invention, and it is understood that this invention is not limited to the illustrated embodiments described above.

We claim:

1. A pneumatic tool having an exhaust port and a sound muffling structure fitted within said exhaust port to seal said exhaust port, wherein said sound muffling structure comprises a nonwoven web of fibers coated with a binder resin, wherein said fibers have diameters of about 30 to about 100 microns, and wherein the web has a compression resistance energy of about 0.09 to about 0.30 Joules.

2. The pneumatic tool of claim 1 wherein the compression resistance energy ranges from about 0.10 to about 0.14 Joules.

3. The pneumatic tool of claim 1 wherein the fiber diameter ranges from about 35 to about 100 microns.

4. The pneumatic tool of claim 1 wherein the fibers are formed from a material selected from the group consisting of polyester resins, polyamide resins, and polyolefin resins.

5. The pneumatic tool of claim 1 wherein the binder resin is selected from the group consisting of phenolaldehyde resins, butylated urea aldehyde resins, epoxide resins, polyester resins, acrylic resins, styrene-butadiene resins, plasticized vinyl, polyurethanes, and mixtures thereof.

6. The pneumatic tool of claim 1 wherein the amount of binder resin ranges from about 100 to 400 parts by weight of dry binder resin per 100 parts by weight of nonwoven web.

7. The pneumatic tool of claim 1 wherein the nonwoven web has a saturant coating of an oil and water resistant viscoelastic damping polymer coated therein.

8. The pneumatic tool of claim 7 wherein the viscoelastic damping polymer is selected from the group consisting of polyacrylates, styrene butadiene rubbers, and silicone rubbers, acrylic rubbers, natural rubbers, urethane rubbers, and butyl rubbers.

* * * * *